US005351472A

United States Patent [19]

Ohashi

[11] Patent Number: 5,351,472

[45] Date of Patent: Oct. 4, 1994

[54] FLUFFING SUPPRESSING DEVICE

[75] Inventor: Kenji Ohashi, Uji, Japan

[73] Assignee: Murata Kikai Kabushiki Kaisha, Kyoto, Japan

[21] Appl. No.: 860,251

[22] Filed: Mar. 31, 1992

Related U.S. Application Data

[63] Continuation of Ser. No. 637,217, Jan. 3, 1991, abandoned.

[30] Foreign Application Priority Data

Jan. 10, 1990 [JP] Japan ..... 2-2931

[51] Int. Cl.[5] ..... D01H 7/46; B65H 54/00

[52] U.S. Cl. ..... 57/333; 242/18 R

[58] Field of Search ..... 57/22, 261, 295, 296, 57/308, 309, 333, 350; 242/18 R

[56] References Cited

U.S. PATENT DOCUMENTS

| | | | |
|---|---|---|---|
| 3,279,164 | 10/1966 | Breen et al. | 57/333 X |
| 3,453,817 | 7/1969 | Strub, Jr. | 57/309 X |
| 3,468,113 | 9/1969 | Jackson | 57/352 X |
| 3,593,514 | 7/1971 | Stanley | 57/309 X |
| 3,783,596 | 1/1974 | Waldkirch | 57/296 |
| 3,826,075 | 7/1974 | Maruyama et al. | 57/333 X |
| 3,939,635 | 2/1976 | Rehn et al. | 57/296 |
| 4,009,563 | 3/1977 | Lenz et al. | 57/333 |
| 4,143,506 | 3/1979 | Pierce et al. | 57/22 |
| 4,183,202 | 1/1980 | Morihashi | 57/333 X |
| 4,242,859 | 1/1981 | Lundgren | 57/333 X |
| 4,419,859 | 12/1983 | Mima | 57/261 X |
| 4,463,652 | 8/1984 | Monget et al. | 57/295 X |
| 4,573,313 | 3/1986 | Bertrams | 57/22 |
| 4,619,109 | 10/1986 | Suzuki et al. | 57/261 |
| 4,858,288 | 8/1989 | Hodgin et al. | 57/350 X |

FOREIGN PATENT DOCUMENTS

| | | | |
|---|---|---|---|
| 1244630 | 7/1967 | Fed. Rep. of Germany | 57/352 |
| 3236971 | 4/1983 | Fed. Rep. of Germany | 57/333 |
| 3744758 | 12/1988 | Fed. Rep. of Germany | 57/261 |

*Primary Examiner*—Daniel P. Stodola
*Assistant Examiner*—Michael R. Mansen
*Attorney, Agent, or Firm*—Spensley Horn Jubas & Lubitz

[57] ABSTRACT

A fluffing suppressing device for a winder for winding spun yarns capable of suppressing fluffing to a degree that may not cause troubles attributable to fluffs when the spun yarns are used as warp yarns on an air jet loom or the like. The present invention provides a fluffing suppressing device to be placed in a yarn path on the winder comprising a nozzle having an air injection holes for injecting air into a yarn passage in direction tangent to the yarn passage.

16 Claims, 6 Drawing Sheets

FLUFFING SUPPRESSING DEVICE

This is a continuation of application Ser. No. 07/637,217, filed on Jan. 3, 1991, now abandoned.

FIELD OF THE INVENTION

The present invention relates to a fluffing suppressing device for yarn winders, such as automatic yarn winders for winding spun yarns, doubling and twisting frames and warping machines.

RELATED ART STATEMENT

Spinning bobbins produced by winding spun yarns on bobbins on a spinning frame are supplied rarely for final uses because each spinning bobbin has a small amount of yarn. Therefore, the yarns wound in the spinning bobbins are rewound by a yarn winder to form a large package, or two or three single yarns unwound from the spinning bobbins are doubled and twisted on a doubling and twisting frame. Spun yarns are subjected to a winding operation or a warping process.

In a winding process for winding spun yarns, in general, the spun yarns are fluffed and fluffs intertwine to cause problems. For example, increased force is required for shedding in weaving the fluffed spun yarn on a loom thereby obstructing the high-speed operation of the loom, breaking the spun yarns or obstructing the insertion of weft yarns. Such troubles are significant problems in an air jet loom which operates at a high weaving speed.

OBJECT AND SUMMARY OF THE INVENTION

Accordingly, it is an object of the present invention to provide a fluffing suppressing device for yarn winders for winding spun yarns, capable of suppressing fluffing to a degree that may not cause problems attributable to fluffs when the spun yarns wound by the yarn winders are used as warp yarns on an air jet loom or the like.

To achieve the object, the present invention provides a fluffing suppressing device to be placed in a yarn path on a yarn winder, comprising a yarn guide member defining a yarn passage, and a nozzle having an air injection hole for injecting air into the yarn passage in a direction tangential to the yarn passage.

The fluffing suppressing device suppresses fluffing by surrounding a spun yarn with whirling air currents within the nozzle when winding the spun yarn on a yarn winder.

DETAILED DESCRIPTION OF PREFERRED EMBODIMENT

A fluffing suppressing device in a preferred embodiment according to the present invention as applied to an automatic yarn winder is explained below with reference to the accompanying drawings.

Figure 1:
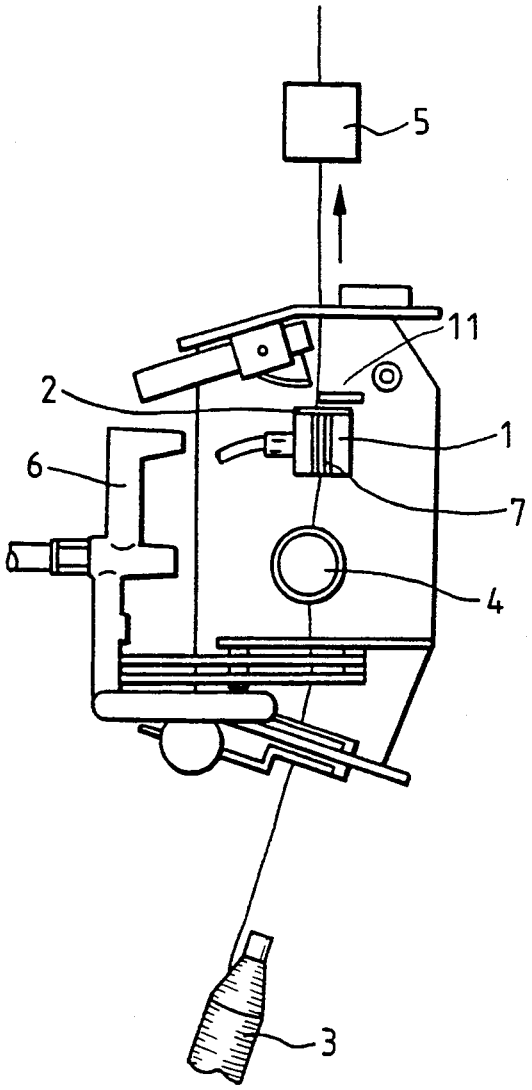
FIG. 1 is a plan view of a portion of an automatic yarn winder in which a nozzle is installed.
Figure 2:
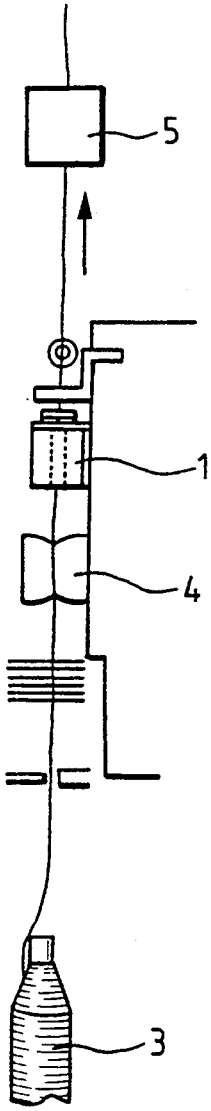
FIG. 2 is a side elevation of the portion shown in FIG. 1.

FIGS. 1 and 2 show a portion of an automatic yarn winder in which a nozzle 1 is installed. The automatic yarn winder draws out a spun yarn from a yarn supply bobbin 3 formed in a spinning frame. Then, the spun yarn is passed sequentially through a balloon breaker, a tension disk device 4, a slub catcher 5, a yarn piecing device and a traverse drum, and is wound on a package. Indicated at 6 is an air blower for blowing off fly waste.

The nozzle 1 of the fluffing suppressing device of the present invention is disposed directly above the tension disk device 4.

Figure 3:
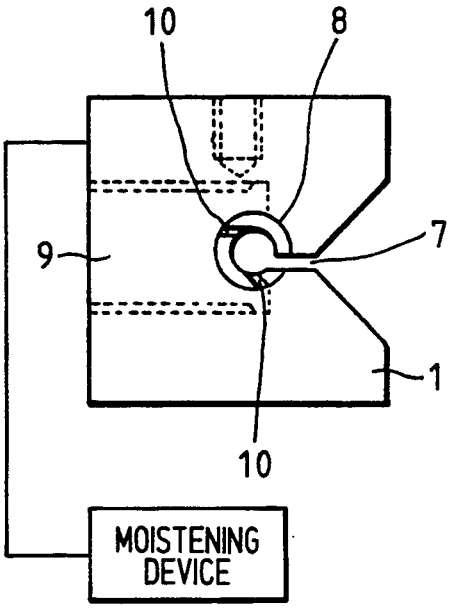
FIG. 3 is a plan view of the nozzle.
Figure 5A:
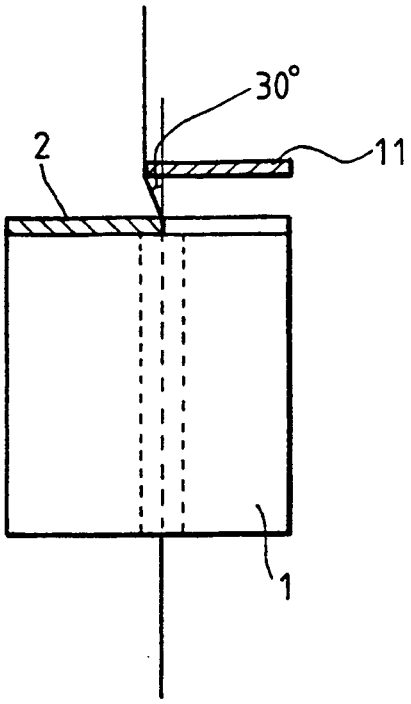
FIG. 5*a* is a longitudinal sectional view of the nozzle provided with an upper nozzle cap.
Figure 4:
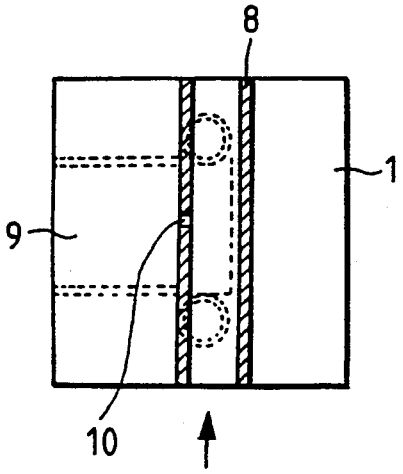
FIG. 4 is a longitudinal sectional view of the nozzle.

The nozzle 1 will be described with reference to FIGS. 3 and 4. FIG. 3 is a plan view of the nozzle 1 and FIG. 4 is a longitudinal sectional view of the nozzle 1. The nozzle 1 has a nozzle body provided in its central portion with a yarn guide pipe 8 longitudinally extending through the nozzle body. A slit 7 is formed in one side surface of the nozzle body of the nozzle 1 so as to communicate with the interior of the guide pipe 8. The slit 7 opens to the front, namely, to this side as viewed in FIG. 1. A plurality of air injection holes 10 are formed in the middle portion of the yarn guide pipe 8. An air inlet 9 is formed in the nozzle body of the nozzle 1 to inject air through the air injection holes 10 in direction perpendicular to the air injection holes 10. The air injection holes 10 extend horizontally in directions parallel to tangents to the yarn guide pipe 8, respectively. Accordingly, false twists are inserted in the spun yarn by whirling air currents while the spun yarn passes the nozzle 1; that is, portions of the spun yarn respectively on the opposite sides of a point corresponding to the air injection nozzles 10 are twisted respectively in opposite directions.

Figure 5B:
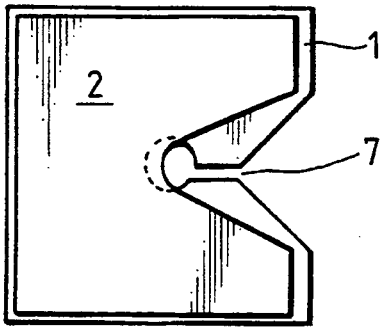
FIG. 5*b* is a plan view of the nozzle provided with an upper nozzle cap.

An upper nozzle cap 2 provided with a recess as shown in FIG. 5*b* is put on the upper end of the nozzle 1. The upper nozzle cap 2 regulates the position of the yarn in cooperation with a control plate 11 disposed above the nozzle 1. Ordinarily, the yarn departs the nozzle 1 in a direction inclined at 30° (departure angle) to the axis of the nozzle 1.

The slit formed in the nozzle body of the nozzle 1 enables automatic yarn piecing and similar automatic operations.

Cotton yarns as fine as 40 yarn count were wound on a yarn winder for test winding under the following conditions: 25 g in winding tension, 900 m/min in winding speed and 30° in departure angle by using three nozzles A, B and C differing from each other in nozzle length and the inclination of the air injection holes to the yarn running path (inclination), each of 3 mm in the inside diameter of the yarn guide pipe and 0.6 mm in the diameter of the air injection holes and provided each with two air injection holes. Air injection pressure was 6 kg/cm$^2$.

Nozzle A: Nozzle length: 20 mm, Inclination: 45°

Nozzle B: Nozzle length: 40 mm, Inclination: 45°

Nozzle C: Nozzle length: 20 mm, Inclination: 90° (horizontal)

Figure 6:
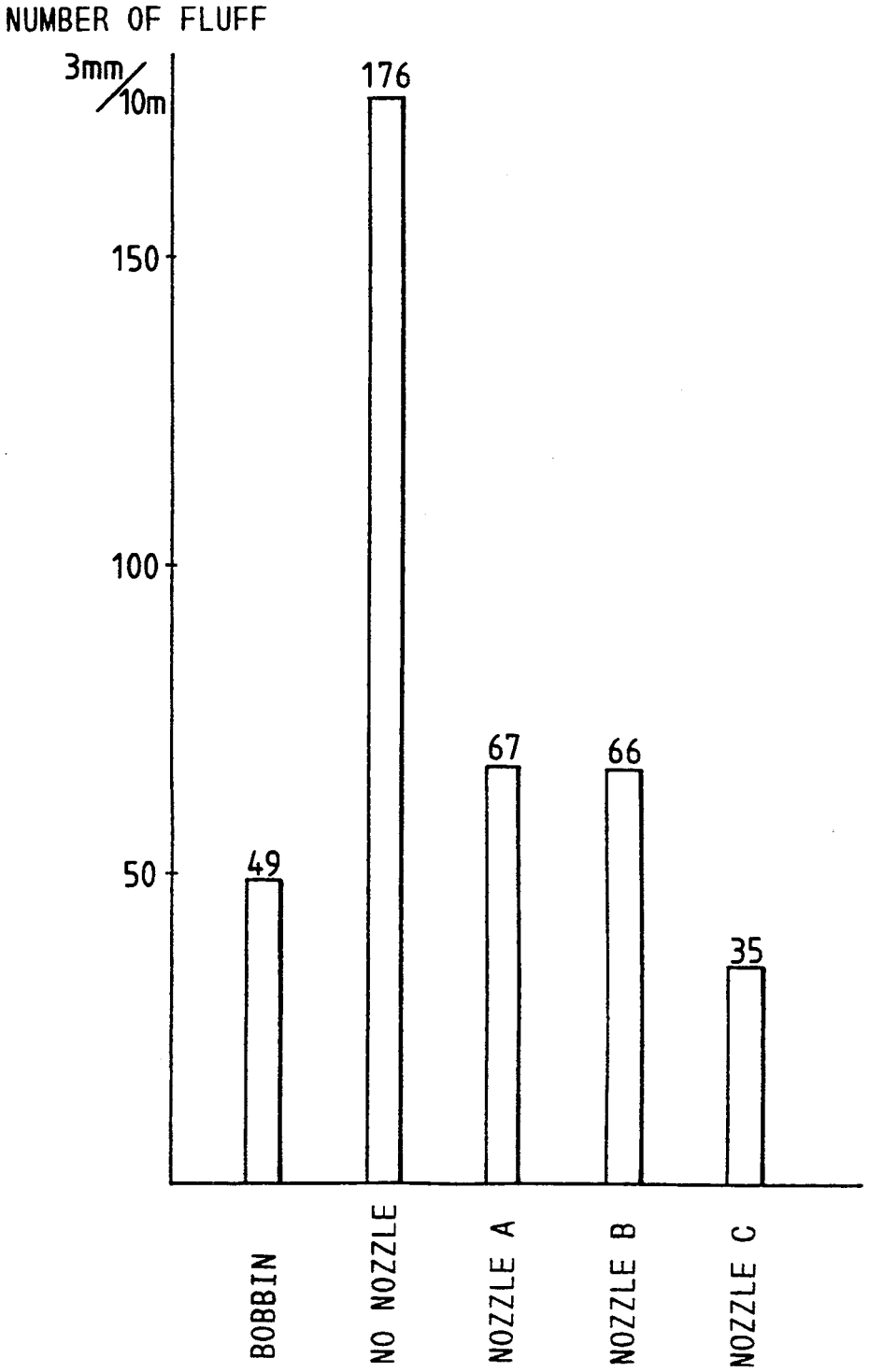
FIGS. 6, 7 and 8 are graphs showing the results of test winding operations under different test conditions in terms of the number of fluffs in spun yarns.

The fluffing suppressing effect of the nozzles A, B and C was evaluated by the number of fluffs of 3 mm or longer in length in 10 m of the tested spun yarns. The results of the test winding are shown in FIG. 6. The numbers of fluffs of 3 mm or longer in length in 10 m of the spun yarns were 49 in the yarn on the supply packages, 67 in the yarns on yarn packages wound by using the nozzle A, 66 in the yarns on yarn packages wound by using the nozzle B and 35 in the yarns on yarn packages wound by using the nozzle C, whereas the number of fluffs of 3 mm or longer in length in yarns on yarn packages wound without using any nozzle was 176. Thus, the test winding proved the very significant fluffing suppressing effects of the various nozzles. As is obvious from FIG. 6, the fluffing suppressing effect of the nozzle is not dependent on the nozzle length. The nozzle provided with the air injection holes of 90° in inclination, namely, horizontal air injection holes, has the highest fluffing suppressing effect.

Blended spun yarns of 35% cotton fibers and 65% polyester fibers, as fine as 48 yarn count were subjected to test winding on a yarn winder provided with the nozzle C. The rest of the test conditions are the same as those applied to the test winding of the 40 count yarns. The numbers of fluffs of 2 mm, 3 mm and 4 mm or longer in 10 m of yarns were counted.

Figure 7:
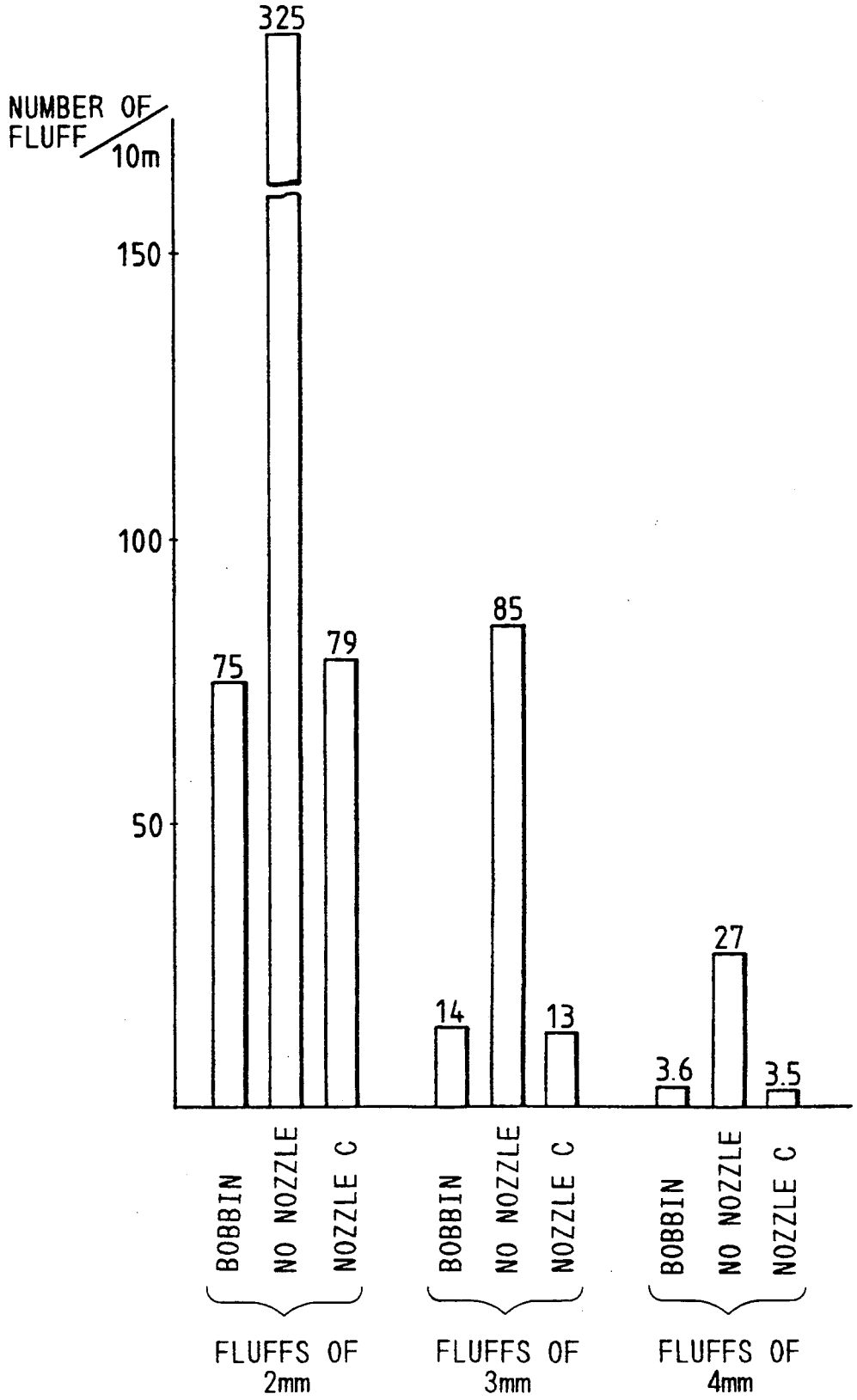

The results of the test winding are shown in FIG. 7. As is obvious from FIG. 7, the use of the nozzle is very effective for suppressing fluffs of all the lengths and particularly effectively for suppressing longer fluffs.

Blended spun yarns of 35% cotton fibers and 65% polyester fibers, as fine as 48 yarn count were subjected to test winding for different air injection pressures on a winder operating at a winding speed of 800 m/min and at a winding tension of 23 g and employing the nozzle C. The rest of the test conditions are the same as those in the foregoing test winding. The number of fluffs of 3 mm or longer in 10 m of the yarn was counted.

Figure 8:
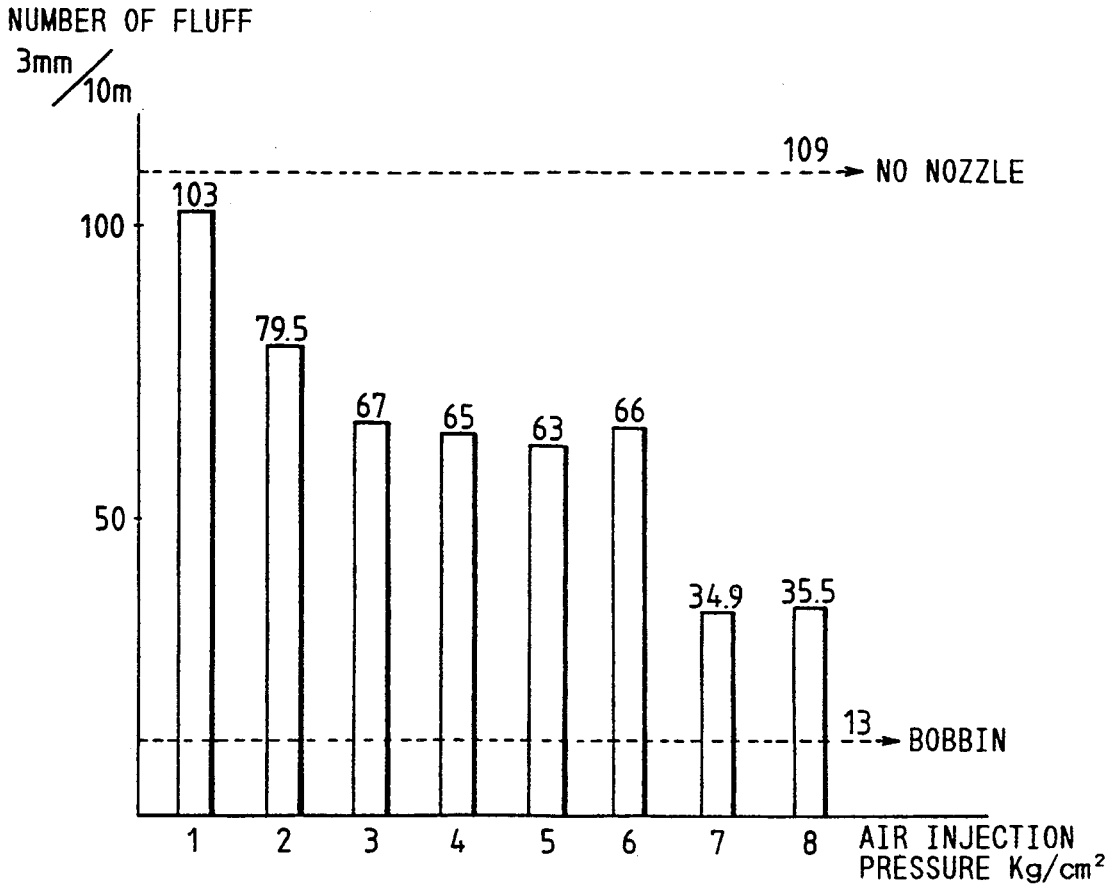

The results of the test winding are shown in FIG. 8. As is obvious from FIG. 8, the greater the air injection pressure, the higher the fluffing suppressing effect.

Although the fluffing suppressing device has been described as applied to an automatic yarn winder, the fluffing suppressing device may be applied to any machines for winding spun yarns other than automatic yarn winders, which has been proved through the test winding operation.

The fluffing suppressing device of the present invention may further include a moistening means for a spun yarn at a intermediate portion of a yarn path in a yarn winder.

It is most preferable to add water to air which is fed to the nozzle 1. For example, a water supply device or moistening device 12 is provided to the air supply pipe communicated with the air inlet 9 to suck water by an air stream, or air which is humidified to a determined rate by a humidifier is fed to the nozzle 1. The moistening position where the moistening means is located may be anywhere a yarn can be moistened effectively, such as at a balloon breaker, tenser disk 4, slub catcher 5, yarn piecing device, traverse drum and the like.

Cotton yarn as fine as 30 yarn count by a single yarn are wound on a yarn winder for test winding under conditions: 25 g in winding tension, 1000 m/min in winding speed and 30° in departure angle by using a nozzle. The conditions of the nozzle used are: 3 mm in the inside diameter of the yarn guide pipe, 20 mm in the nozzle length, 90° in the inclination of the air injection holes to the yarn running path (horizontal), 0.6 mm in the diameter of the air injection holes and provided with two air injection holes, and 6 kg/cm$^2$ in air injection pressure. The test winding is performed supplying humidified air to the nozzle and is also performed supplying air without moisture to the nozzle. The wound bobbin is rewound processed re-winding after it is stored for seven hours. The fluffing suppressing effect was evaluated by the number of fluffs of 3 mm or longer in length in 10 m of the tested spun yarns. The results of the test are shown in FIG. 9.

Figure 9:
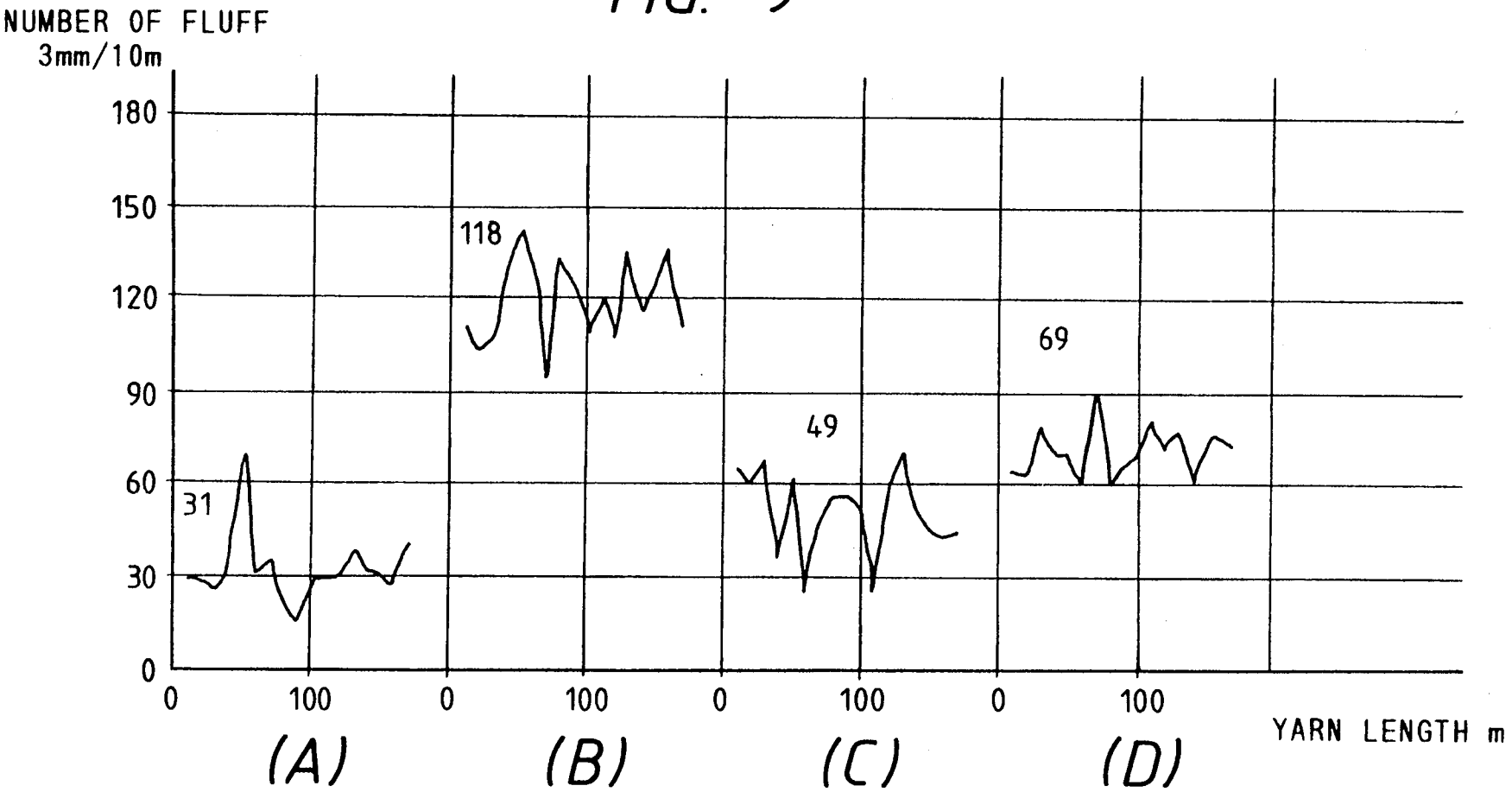
FIG. 9 is a graph showing relation between humidity of air which is supplied to a nozzle and number of fluffs.

In FIG. 9, (A) shows the result of the test of the yarn which was wound through the nozzle in which air not humidified is applied, while (B) shows the result of the test of yarn which was obtained by re-winding the yarn in (A). (C) shows the result of the test of the yarn which was wound through the nozzle in which humidified air is supplied while (D) shows the result of the test of yarn which was obtained by re-winding the yarn in (C). The numerals shown over each graph (A), (B), (C) or (D) designate average number of fluffs in 17 measurements.

According to the result of the test, fluffs of a yarn which was wound through the nozzle in which none-humidified air is supplied, are increased 3.8 times after the yarn is re-wound. While, fluffs of a yarn which was wound through the nozzle in which humidified air is supplied, are increased only 1.4 times after the yarn is re-wound.

Accordingly, adding moisture to a yarn which is running a yarn path in a yarn winder for a spun yarn contributes to suppressing fluffs in subsequent processes such as doubling and the like. It is supposed that the suppressing of fluffs is attained by removing the latent bend of fibers by an application of moisture and by pressing the fibers onto the surface of a yarn in the winding step.

In foregoing description, an example in which the fluffing suppressing device is provided in an automatic winder is illustrated. However, the same fluffing suppressing effect is attained by providing the device of the present invention to any other apparatus for rewinding a spun yarn and such is confirmed by experiments.

As is apparent from the foregoing description, the present invention has the following effects.

The fluffing suppressing device suppresses fluffing effectively in winding spun yarns on yarn winders and, under most favorable conditions, suppresses fluffing perfectly. Accordingly, the yarns wound on a yarn winder provided with the fluffing suppressing devices can be used as warps on air jet looms or the like while scarcely causing troubles normally caused by spun yarns wound without using the fluffing suppressing device.

The nozzle provided with the slit enables automatic operation including automatic yarn piecing operation.

What is claimed is:

1. A fluffing suppressing apparatus for use with an automatic winder for winding spun yarns, the automatic winder defining a yarn winding path, the fluffing suppressing apparatus comprising:

an air nozzle disposed substantially in the yarn winding path for imparting air currents to the spun yarn as the spun yarn is wound by the automatic winder, a yarn guide pipe extending longitudinally through the air nozzle, the yarn guide pipe defining a yarn running path having a first end and a second end, a first opening at the first end of the yarn running path, and a second opening at the second end of the yarn running path, at least one air injection hole formed in the yarn guide pipe for injecting air supplied to the air nozzle into the yarn guide pipe in a direction tangent to the yarn guide pipe and at a predetermined angle with respect to the yarn running path, a nozzle cap defining a portion which partially covers the second opening of the yarn guide pipe, and a control plate disposed adjacent the air nozzle such that the nozzle cap is substantially between the control plate and the air nozzle, wherein the control plate controls the position of the yarn in cooperation with the nozzle cap.

2. A fluffing suppressing device as claimed in claim 1, wherein a plurality of air injection holes are formed in the yarn guide pipe.

3. A fluffing suppressing device as claimed in claims 2, wherein said air injection holes are formed to be perpendicular to a yarn running path within the yarn guide pipe.

4. A fluffing suppressing device according to claim 1, wherein the predetermined angle is substantially equal to 90°.

5. A fluffing suppressing device according to claim 1, wherein the at least one air injection hole is formed perpendicular to a yarn running path within the yarn guide pipe.

6. A fluffing suppressing device according to claim 1, wherein the control plate and the nozzle cap control the position of the yarn such that the yarn departs the nozzle at a predetermined angle with respect to an axis of the yarn guide pipe.

7. A fluffing suppressing device according to claim 6, wherein the predetermined angle with respect to an axis of the yarn guide pipe is approximately 30°.

8. A fluffing suppressing device as claimed in claim 1, further comprising:

moistening means, operatively connected to the air nozzle, for adding moisture to the air supplied through the air hole so as to moisten a yarn located in the yarn guide pipe.

9. A fluffing suppressing apparatus as claimed in claim 1, wherein the air nozzle and the yarn guide pipe each include a longitudinally extending slit.

10. An automatic winder for winding yarn, the automatic winder defining a yarn winding path, the automatic winder comprising:

winding means for winding yarn from a supply bobbin; and fluff suppressing means for reducing an amount of fluff in the yarn, the fluff suppressing means including an air nozzle disposed substantially in the yarn winding path for imparting air currents to the yarn as the yarn is wound by the automatic winder, a yarn guide pipe extending longitudinally through the air nozzle, and at least one air injection hole formed in the yarn guide pipe for injecting air supplied to the air nozzle into the yarn guide pipe in a direction tangent to the yarn guide pipe and at a predetermined angle with respect to a yarn running path through the yarn guide pipe.

11. An automatic winder as claimed in claim 10, wherein a plurality of air injection holes are formed in the yarn guide pipe.

12. An automatic winder as claimed in claim 11, wherein the air injection holes are formed to be perpendicular to a yarn running path within the yarn guide pipe.

13. An automatic winder as claimed in claim 12, including positioning means provided at one end of the air nozzle for regulating a position of the yarn.

14. An automatic winder as claimed in claim 13, wherein the positioning means includes a nozzle cap disposed on the one end of the air nozzle and a control plate disposed adjacent the air nozzle so that the control plate regulates the position of the yarn in cooperation with the nozzle cap.

15. An automatic winder as claimed in claim 10, including moistening means, operatively connected to the air nozzle, for adding moisture to the air supplied through the air hole so as to moisten a yarn located in the yarn guide pipe.

16. An automatic winder as claimed in claim 10, wherein the air nozzle and the yarn guide pipe each include a longitudinally extending slit.

* * * * *